US005293677A

United States Patent [19]

Lamort

[11] Patent Number: 5,293,677

[45] Date of Patent: Mar. 15, 1994

[54] PROCESS OF MAKING A CYLINDRICAL SLOTTED SIEVE FOR PAPER PULP STRAINER

[75] Inventor: Jean-Pierre Lamort, Vitry le Francois, France

[73] Assignee: E & M Lamort, Vitry le Francois, France

[21] Appl. No.: 868,763

[22] Filed: Apr. 14, 1992

[30] Foreign Application Priority Data

Apr. 17, 1991 [FR] France ..... 91-04693

[51] Int. Cl.[5] ..... B07B 1/18

[52] U.S. Cl. ..... 29/163.6; 209/397

[58] Field of Search ..... 29/6.1, 6.2, 163.6, 29/163.8; 209/273, 397, 398, 399

[56] References Cited

U.S. PATENT DOCUMENTS 5,023,986 6/1991 Gero et al. ..... 29/163.6

FOREIGN PATENT DOCUMENTS 2-89915 12/1986 Japan ..... 29/163.6

*Primary Examiner*—Timothy V. Eley

*Attorney, Agent, or Firm*—Darby & Darby

[57] ABSTRACT

Cylindrical sieve for paper pulp strainer of the type of thin sheetmetal is formed by juxtaposition of U-shaped sectional elements (2) made from a metal strip. The element (2) has a first flange (3), a bottom (4), followed by a second flange (5) bent over toward the exterior of the U-shaped element on itself so as to define a space (6) in the fold thus formed, intended to receive and hold the first flange (3') of the adjacent element (2'). The base of the U-shaped element is pricked to form depressions or slots.

11 Claims, 2 Drawing Sheets

FIG.1
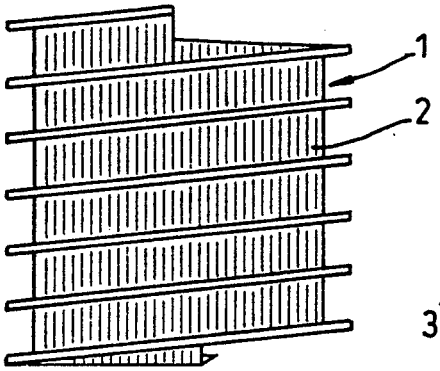
FIG.2
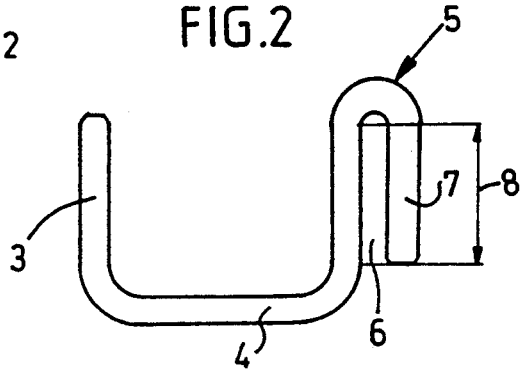
FIG.5
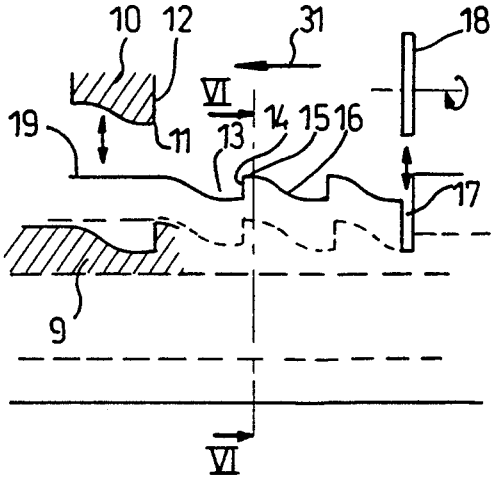
FIG.6
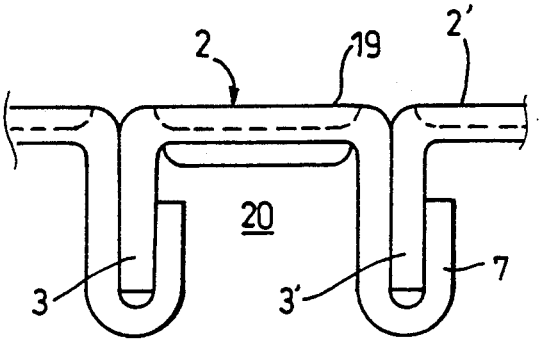
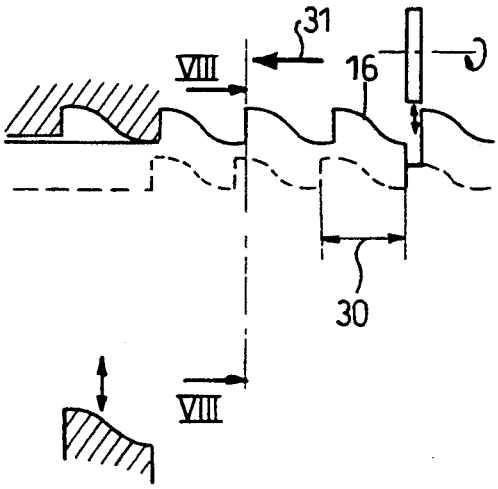
FIG.7
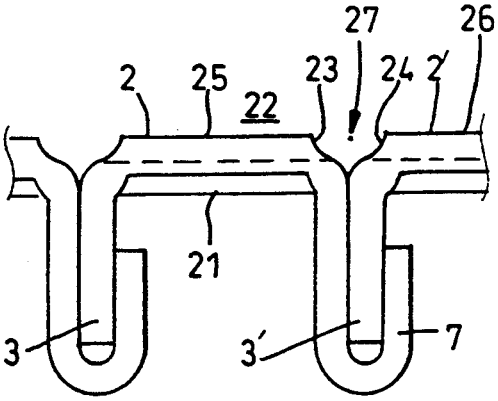
FIG.8

FIG. 3
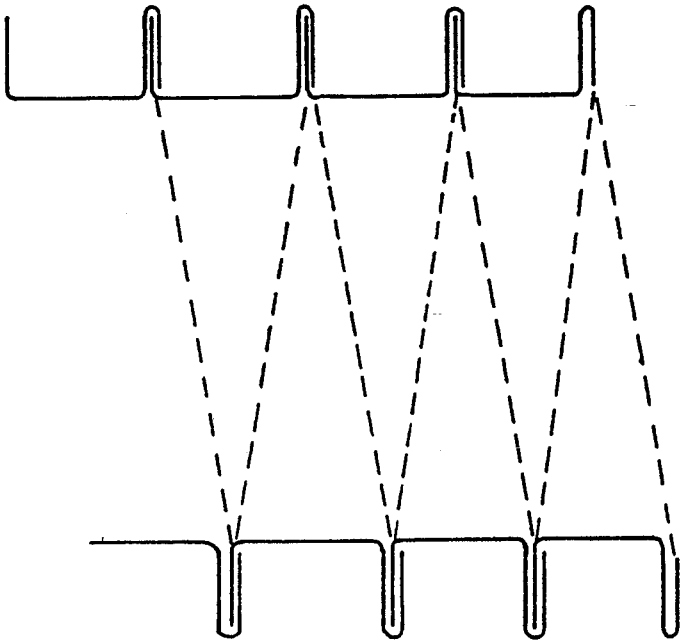
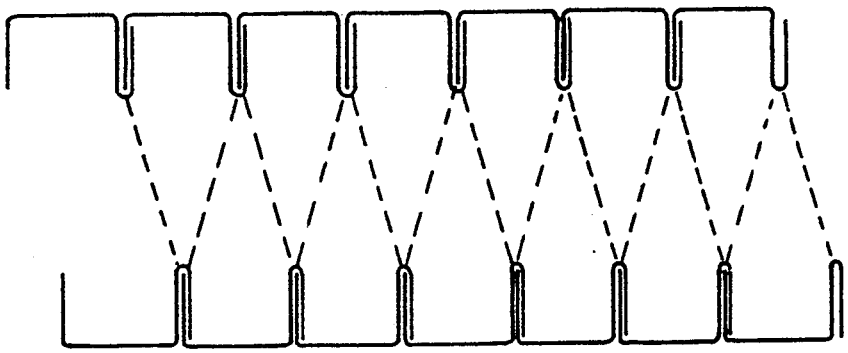
FIG. 4

PROCESS OF MAKING A CYLINDRICAL SLOTTED SIEVE FOR PAPER PULP STRAINER

BACKGROUND OF THE INVENTION

The present invention relates to a process of making a cylindrical slotted sieve for strainers and classifiers of paper pulp obtained from used paper, and the sieve manufactured by this process.

In the manufacture of paper pulp from used paper numerous sieves are used both for removing the impurities and for classifying the fibers according to their length.

These sieves are generally perforated cylinders mounted fixed in an enclosed space having at least one inlet of dirty pulp, one outlet of sifted pulp, and one outlet for the waste. The pulp is agitated by one or several vanes which rotate at great speed in the immediate vicinity of the perforated surface.

According to the characteristics of the pulp to be strained (for example the length of the fibers, the nature and size of the contaminants), one uses sieves with holes or with slots. In addition these perforations are usually accompanied by an obstacle which produces pulsations favoring the sifting.

The perforations are normally made by machining sheetmetal of a thickness of about one centimeter. But as this machining presents great difficulties, the applicant has made a sieve from a sheetmetal of thin thickness, of the order of 2 millimeters described in EP-A-O 0 354,846. This sieve has U-sections joined side by side and their bottom is perforated. The perforations are also obtained by machining (sawing, drilling) and the thinness of the sheetmetal greatly simplifies these operations.

However, this technique of making cylindrical sieves of thin sheetmetal still presents difficulties:

- when the cylinder is obtained by juxtaposition of arched, i.e., U-shaped, sections, the sections are joined and held tightly together by welding of the adjacent walls or by placing a rider which pinches the two walls. In practice this connection can be made only when the walls of the U-shaped sections are turned toward the outside of the cylinder;
- when it is provided that the sifting openings are associated with an obstacle, the machining is such that it is always situated on the outward side of the bottom of the U-shaped section.

As the walls of the U-shaped sections are turned toward the outside of the cylinder, this practically makes only the production of centrifugal sieves possible.

OBJECTS OF THE INVENTION

A first objective of the invention aims to solve the problem described above. A second objective is to improve the process of perforating.

In fact, on the one hand the perforating still requires performing a relatively complex operation due to the fact that the machining of the slots and obstacles includes two sawing passes followed by a deburring operation. On the other hand, this machining, even if it removes a small amount of material because of the relative small thickness of the sheetmetal, is important relative to this same small thickness and weakens the strength of the wall.

BRIEF DESCRIPTION OF THE INVENTION

The object of the present invention is a cylindrical sieve for paper pulp strainers of the type of thin sheetmetal and formed by juxtaposition of U-shaped section elements made in a metal strip. An element has a first flange, a bottom, followed by a second flange bent toward the outside of the U over itself so as to define a space in the fold thus formed intended to receive and hold the first flange of the adjacent element.

The invention further covers the process of making such a sieve. In the process a plurality of elements of equal length are assembled with the bent flange of each element engaging on the opposite flange of the adjacent element. The assembly forms a wall which is bent to form a cylinder, and then the ends of the outer elements are welded together to complete the cylinder.

According to another embodiment of the process the element is wound spirally or helically, each turn forming a spiral. The spirals are assembled by introduction of the fold of the second flange on the end of the first flange of the adjacent spiral or vice versa.

The invention further covers the process of making the slots of the sieve. Here, first the metal strip is made into U form, and it is positioned on a template. The bottom of the U is pricked (punched) by a knife whose end presents a cutting edge perpendicular to the axis of the strip and a wedge-shaped profile, one of whose faces is perpendicular to the pricked surface. The pricks are made spaced at regular intervals.

In a first variant, the pricking does not go through and forms only a deformation whose profile presents a wall perpendicular to the surface of the bottom of the U which is engaged by the knife followed by an inclined wall. The slot is obtained by a saw cut at right angles to the vertical wall.

In a second variant, the pricking extends through the strip and cuts a slot whose width is determined by the depth of the penetration of the knife.

The process is further distinguished by the following characteristics:

- the pricking is done on the external face of the bottom of the U toward the interior. As the surface of the sieve is defined by the external face of the bottom of the U, this surface then presents a plurality of perforated hollows:
- the distance between two successive pricks is small so that, considered in the direction of flow of the pulp, the inclined face of a deformation is immediately followed by the vertical wall, the profile being then in sawtooth form.
- the pricking is done on the inner face of the bottom of the U toward the exterior. Here, the surface of the sieve then presents a plurality of obstacles in relief;
- the pricking pattern is determined so that the adjacent and opposite lateral ends of two adjacent obstacles form, when the U-shaped elements are juxtaposed, a groove of approximately concave form.

BRIEF DESCRIPTION OF THE DRAWINGS

To better understand the invention and the advantages that it brings, an example of realization of the sieve according to the invention has been represented in the annexed drawings in which:

FIG. 1 represents a schematic view of a profile of the sieve according to the invention;

FIG. 2 represents a view in transverse section of a U-shaped element according to the invention;

FIG. 3 represents a schematic view in section of a first variant of realization of a cylindrical sieve according to the invention;

FIG. 4 represents a schematic view in section of a second variant of realization of a cylindrical sieve according to the invention;

FIG. 5 represents a longitudinal side view of an element perforated by pricking in intaglio;

FIG. 6 represents a view in transverse section along VI—VI of the assembly of FIG. 5;

FIG. 7 represents a longitudinal side view of an element perforated by pricking in relief; and FIG. 8 represents a view in transverse section along VIII—VIII of the assembly of FIG. 7.

DETAILED DESCRIPTION OF THE INVENTION

As FIG. 1 shows, the sieve is a cylinder 1 formed from a plurality of identical U-shaped longitudinal metal elements 2, which are formed into a cylinder.

Each element 2 is made of a thin strip of metal or band. The strip is bent into a U-shape so that in transverse section the element has a first flange 3, a bottom 4, followed by a second flange 5 folded over toward the exterior of the U on itself to define a space 6 in the fold thus formed. The space 6 is intended to receive and hold the first flange 3' of an adjacent element 2'.

The folded portion 7 or flap of the second flange substantially covers the adjacent first flange 3'. Preferably the flap extends over the full height 8 of the flat portion of flange 3'. In this manner the first flange is held in the fold of the adjacent second one over its entire flat portion.

In a first variant of realization of forming a cylinder of the elements 2, a plurality of elements 2 of equal length are assembled, the bent flange 5 of each element engaging on the opposite flange 3' of the adjacent element 2'. The assembly forms a wall which is bent to form a cylinder, and then the ends of the outer elements are welded together.

In a second variant, each element 2 is wound spirally or helically, each turn forming a spiral. The spirals are assembled by introduction of the space 6 of the fold of the second flange 5 on the end of the first flange 3' of the adjacent spiral or vice versa.

As is seen in FIGS. 3 and 4, the assembly can be made by arching the U-shaped element with the flanges being oriented toward the exterior of the cylinder (FIG. 3) or by arching it with the flanges being oriented toward the interior (FIG. 4). Accordingly, either a centrifugal or a centripetal sieve can be made, and this without requiring a single weld to be made except to join the outer element to complete the cylinder.

Before the operations of arching and assembling, the elements are perforated, the perforations being either circular holes or slots.

For slotted sieves there is known through EP-.A.0.354.846 a process of perforation by successive sawings. This process not only permits obtaining a calibrated and very fine slot but also making an obstacle forming profile.

According to the invention, the slots are not obtained solely by sawing but essentially by pricking. First the metal strip is brought into U-form, it is positioned on a template 9 and the bottom of the U is pricked by means of a knife 10 whose end presents a cutting edge 11 perpendicular to the axis of the strip and a wedge-shaped profile one of the faces 12 of which is perpendicular to the pricked surface. The pricks are made spaced with a constant spacing between them.

In a first variant the pricking does not go through the element and forms only a deformation 13 whose profile presents a wall 14 perpendicular to the surface 15 of the bottom of the U followed by an inclined wall 16. The slot 17 is obtained by a saw cut 18 at right angles to the vertical wall.

In a second variant (not shown) the pricking goes through the metal of the strip and cuts the slot the width of which is determined by the depth of penetration of the knife 10.

The distance between two successive pricks is small so that the inclined face 16 of a deformation is immediately followed by the vertical wall 14 of the next deformation, the wall being then in sawtooth form.

The pricking device may be a simple hammer driven in an alternating movement or a rotating milling wheel, whereby a high speed of perforation can be attained.

In the embodiment represented in FIGS. 5 and 6, the pricking is done on the outer face of the bottom of the U toward the interior 20. As the sifting surface is determined by the outer face of the bottom of the U, this surface then presents a plurality of perforated hollows: the sieve is perforated in intaglio.

In the embodiment represented in FIGS. 7 and 8, the pricking is done on the inner face 21 of the bottom of the U toward the exterior 22; the surface of the sieve then presents a plurality of obstacles in relief: the sieve is perforated in relief.

The pricking giving an obstacle in relief is determined so that when two adjacent elements 2, 2' mounted spirally are juxtaposed, the adjacent and opposite lateral ends 23, 24 of two adjacent obstacles 25, 26 are approximately aligned and form a groove 27. The groove 27 forms a helicoidal path whose function it is to receive and guide the fraction of the rejected pulp toward the discharge outlet of the device in which the sieve is used.

This process according to the invention of making a cylindrical sieve offers numerous advantages:

- great sturdiness due to the triple thickness of the flanges, and also due to the fact that there is practically no loss of material by machining;
- great flexibility due to the fact that there is no weld;
- increased efficiency of the job of perforation by pricking.

I claim:

1. Process of making slots in a sieve element for separating solid material in a liquid stream, comprising the steps of providing a metal strip, forming from said strip an element of generally U-shape having a bottom, a first flange and a second flange each extending from said bottom, positioning said element on a template, pricking the bottom of the element at a regular spacing by a knife having a cutting edge perpendicular to the longitudinal axis of the strip and a wedge-shaped profile one face of which is perpendicular to the pricked surface.

2. Process according to claim 1 wherein the pricking does not go through and only forms a deformation the profile of which presents a vertical wall perpendicular to the element surface engaged by the knife of the bottom of the element followed by an inclined wall, and forming a slot by a saw cut at a right angles to said wall.

3. Process according to claim 2 wherein the distance between two successive pricks is small so that, in the direction of flow of the material being separated the inclined wall is immediately followed by the vertical wall, the profile being in sawtooth form.

4. Process according to claim 1 wherein the pricking pierces the strip and cuts each slot whose width is determined by the depth of the penetration of the knife.

5. Process according to claim 1 wherein the pricking is made on the external face of the bottom of the element toward the interior to form hollows on the pricked bottom surface of the sieve.

6. Process according to claim 1 characterized in that the pricking is made on the inner face (21) of the bottom of the U toward the exterior (22).

7. Process according to claim 6 wherein an obstacle in relief is formed adjacent opposite lateral ends of two adjacent obstacles forming a groove when several of said elements are juxtaposed.

8. A process according to claim 1 further comprising the step of folding a flap bent over from said second flange of the element to define a space between said second flange and said flap.

9. Process of making the sieve according to claim 8 further comprising the steps of forming a plurality of elements, winding each element spirally or helically, assembling the spirals of helices by introduction of the flap of the second flange over the end of the first flange of the adjacent spiral or helix, or vice versa.

10. Process of making the sieve according to claim 8 further comprising the steps of forming an assembly of a plurality of said elements with the bent flap of each element engaging over the first flange of the adjacent element, forming a wall from said assembly which is arched to form a cylinder, and fastening the ends of the assembled elements together.

11. Process according to claim 8 wherein a plurality of elements are formed each being of equal length.

* * * * *